United States Patent [19]

Sojka

[11] 3,990,611

[45] Nov. 9, 1976

[54] PLURAL METERING DISPENSERS WITH WALL SECURING RACK

[75] Inventor: James Andrew Sojka, Reisterstown, Md.

[73] Assignee: Lawrence Peska Associates, Inc., New York, N.Y.

[22] Filed: June 30, 1975

[21] Appl. No.: 591,515

[52] U.S. Cl. ..... 222/135; 222/180; 222/385

[51] Int. Cl.[2] ..... B65D 47/34

[58] Field of Search ..... 222/135, 180, 181, 385, 222/321

[56] References Cited

UNITED STATES PATENTS

| | | | |
|---|---|---|---|
| 2,519,640 | 8/1950 | Echols, Sr. et al. | 222/321 |
| 2,718,335 | 9/1955 | Shippen | 222/135 |
| 3,078,016 | 2/1963 | Judy | 222/181 |
| 3,096,913 | 7/1963 | Corley | 222/181 X |
| 3,178,061 | 4/1965 | Giacalone et al. | 222/181 X |
| 3,349,967 | 10/1967 | Schneller | 222/180 X |

*Primary Examiner*—Robert B. Reeves
*Assistant Examiner*—David A. Scherbel

[57] ABSTRACT

A metering and dispensing apparatus is disclosed for metering and dispensing liquid bath products such as shampoo and the like comprising a plurality of dispensers of the pump type secured to a rack member wherein the rack member has a securing device affixed thereto by which the rack member and dispensing apparatus may be readily affixed to a bathroom wall.

3 Claims, 4 Drawing Figures

FIG.1
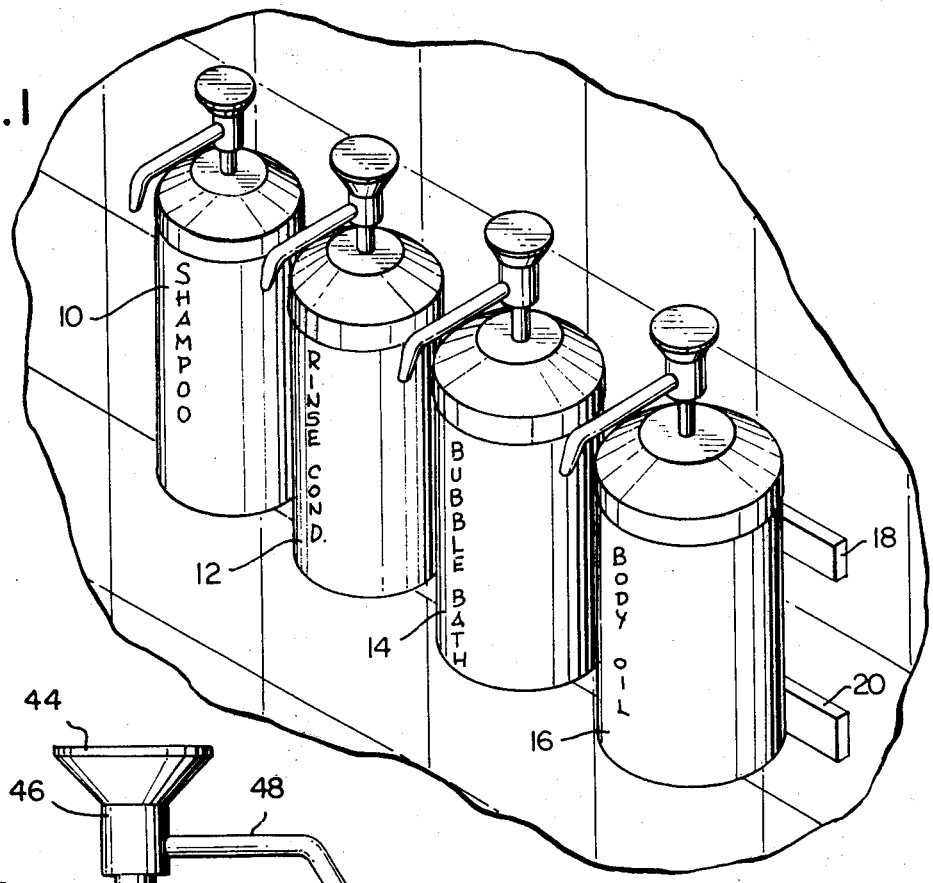
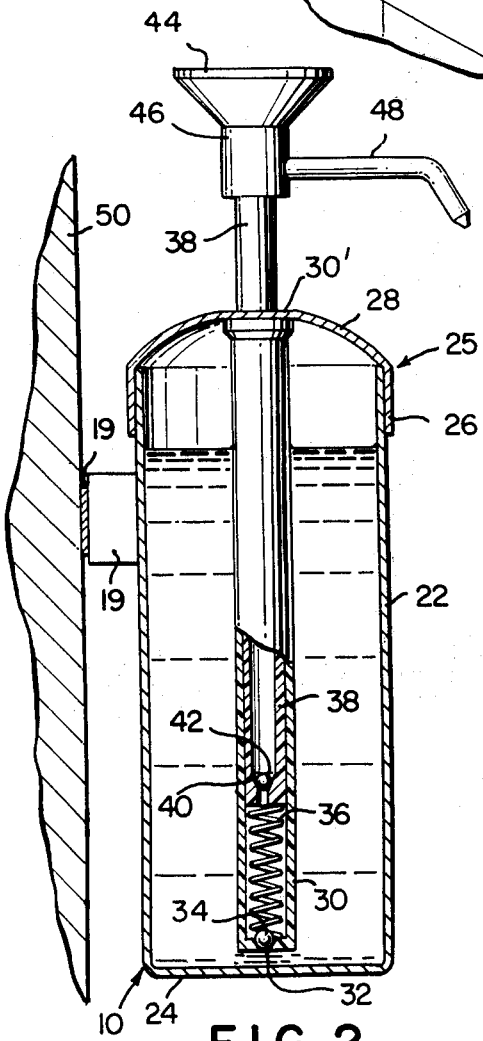
FIG.2
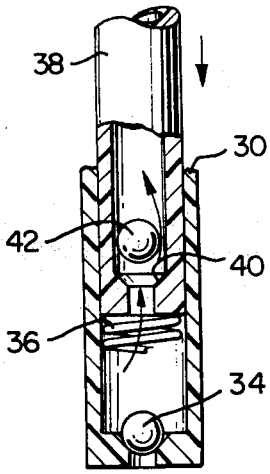
FIG.3
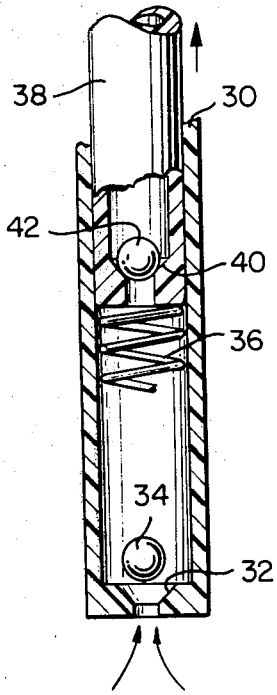
FIG.4

PLURAL METERING DISPENSERS WITH WALL SECURING RACK

SUMMARY OF THE INVENTION

A metering and dispensing apparatus is disclosed for metering and dispensing liquid bath products such as shampoo, rinse conditioner, bubble bath and body oil comprising a plurality of pump dispenser secured to a rack member wherein the rack member has a securing device affixed thereto by which the rack member and dispensing apparatus may be readily affixed to a wall in the bathroom, especially a wall adjacent or next adjacent a shower stall, a bath tub or a bath and shower combination.

BRIEF DESCRIPTION OF THE SEVERAL VIEWS OF THE DRAWINGS

FIG. 1 is a perspective view of one embodiment of the novel metering and dispensing apparatus for liquid bath products of the present invention.

FIG. 2 is a side elevation in section of one embodiment of a single member of the plurality of members employed in the novel metering and dispensing apparatus for liquid bath products of the present invention.

FIGS. 3 and 4 illustrate the operation of the one way valves employed in the pump dispenser according to one embodiment of the present invention.

DETAILED DESCRIPTION

The prior art dispensers employed for the supply of liquid bath products suffered the disadvantage that only one product could be dispensed therefrom and further were not adapted to be readily mounted on walls adjacent or next adjacent shower or bath facilities.

It is therefore an object of the present invention to overcome these and other difficulties encountered in the prior art.

It is a further object of the present invention to provide a metering and dispensing apparatus for dispensing a plurality of liquid bath products.

It is also an object of the present invention to provide such an apparatus comprising a plurality of pump dispensers secured to a rack member having a securing device affixed thereto by which the rack member and the metering and dispensing apparatus may be readily secured to a wall.

These and other objects have been achieved according to the present invention which will be further understood by reference to the disclosure and claims that follow as well as the appended drawings.

Referring to FIG. 2, metering and dispensing apparatus is illustrated according to one embodiment of the present invention wherein a container 10 is shown which is a hollow open top cylinder having side wall 22 and bottom closure 24 integral therewith. A closure is provided to fit over the opening at the top of said container comprising a cap 25 having an annular skirt 26 which extends downward and over the top of said wall 22 and is of a sufficient diameter to provide a friction fit between said cap and said container. Skirt 26 extends upwardly and convexly to form a dome like structure 28 having a flattened circular center 30' integral with and centrally located on the top of said cap 25. An opening is provided in the center of cap 25 through which is extended tube 38. Tube 38 is mounted concentrically in and slidingly abuts tube 30 wherein tube

30 is secured to cap 25 at the opening thereof and extends downward from the cap into the body of the container 10. The bottom of tube 30 is positioned substantially at the bottom of container 10 so that it is readily adapted to be in contact with the contents of the container at the bottom thereof. Inwardly and downwardly flared first valve seat 32 is provided in tube 30 and is positioned over the intake port or opening at the bottom of tube 30. A one way ball valve 34 adapted to be received in valve seat 32 is provided so that a fluid seal is maintained in a downward direction and a flow path maintained in an upward direction in tube 30. Tube 38 extends upwardly and vertically through the opening in cap 25 to thumb engaging member 44, tube 38 also extending downwardly so that there is some pumping distance between the bottom of tube 38 and tube 30, the distance being pre-selected to displace a fixed quantity of liquid bath product so that this amount may be metered out when the apparatus of the present invention is used. An inwardly and downwardly flared valve seat 40 is provided in tube 38 and is positioned over an intake port or opening at the bottom of tube 38. A one way ball valve 42 is positioned in valve seat 40 which seals fluid flow in tube 38 in a downward direction and allows the flow of fluid in tubing 38 in an upward direction. Thumb engaging means 44 comprises an inverted frusto-conical member extending upwardly and outwardly from where it joins tube 38 to provide a sufficient area at the top thereof for fully receiving a thumb member. A discharge tube 48 extends laterally into and fluidly communicates with the central passage in tube 38, the discharge tube being positioned substantially at the top of said tube 38. Tube 48 terminates in a downwardly turned segment for directing liquid bath products in a substantially downward direction. Skirt 46 is provided in one embodiment of the present invention and is integral with and extends downward from member 44 and is adapted for frictionally fitting over the upper most end of tube 38 by frictionally engaging the outer wall thereof, discharge tube 48 extending through skirt 46 and being secured thereto either by a friction fit, by means of an adhesive or by screw threads all of which are well known in the art.

The containers such as container 10 or container 10 in combination with containers 12, 14 and 16 are secured to rack 18 having an adhesive surface thereon which may be either a patch of adhesive on either end of the rack, a plurality of such patches or a continuous adhesive strip or mechanical fastening devices secured to the surface thereof any of which faces wall 50 so that said rack may be adhesively secured or mechanically secured to wall 50. Additionally, two racks may be employed such as is illustrated in FIG. 1 showing racks 18 and 20.

In use container 10 is filled with a liquid bath product and member 44 is moved downwardly to displace the fluid contained in tube 30 between the bottom of tube 38 and the bottom of tube 30. As illustrated in FIG. 3 ball valve 42 is displaced upwardly and fluid is forced into tube 38 since any downward movement of fluid in tube 30 is stopped by the action of ball valve 34 which seals the opening in tube 30 in a downward direction. Fluid in tube 38 above ball valve 42 is displaced upwardly as new fluid is introduced into the tube by the aforementioned downward movement and such fluid in tube 38 is then forced out of the opening at the downward pointing end of discharge member 48. In this operation resillient member 36 which comprises a coil spring mounted in the bottom of tube 30 is compressed so that after tube 38 is depressed to displace fluid from the bottom of tube 38, spring 36 forces tube 38 upwardly which causes ball valve 42 to seat and prevent the back flow of any fluid in tube 38 into tube 30. The sealing of tube 38 in this manner allows the bottom thereof to act as a piston surface for raising fluid from container 10 into tube 30 through ball valve 34 which will lift as tube 38 is forced upward by spring 36 the latter steps being clearly illustrated in FIG. 4.

Although the invention has been described by reference to some embodiments it is not intended that the novel apparatus described herein be limited thereby, but that certain modifications are intended to be included as falling within the broad scope and spirit of the foregoing disclosure, the following claims and the appended drawings.

What is claimed is:

1. Metering and dispensing apparatus for liquid bath products comprising a plurality of individual metering and dispensing means secured to wall mountable rack means, said rack comprising horizontal means secured to each of said metering and dispensing means, means integral with said horizontal means for securing said rack to wall means, each of said metering and dispensing means comprising one-piece open top hollow cylindrical container means, the side wall of said container being integral with the bottom of said container, cap means having annular skirt means adapted to frictionally fit over opening means in the top of said container and to frictionally engage the outer wall of said container, said skirt extending upwardly and convexly to the center of said cap, said center comprising a circular flat section integral with and centrally located on the top of said cap, opening means in said center, first tube means, second tube means mounted concentrically in and slidingly abutting said first tube, said first tube secured to said cap at said opening and extending downward from said cap, the terminal end of said first tube being positioned substantially at the bottom of said container, inwardly and downwardly flared first valve seat means positioned over first intake means at the bottom of said first tube, one way ball valve means positioned in said first valve seat for passing fluid in an upward direction, said second tube extending vertically through said opening and upwardly to thumb engaging means and downwardly into said first tube, inwardly and downwardly flared second valve seat means positioned over second intake means at the bottom of said second tube, one way ball valve means positioned in said second valve seat for passing fluid in an upward direction, said thumb engaging means comprising an inverted frusto-conical member outwardly extending from said second tube to provide sufficient area on the top thereof for fully receiving a thumb member and an annular skirt means extending downward from said inverted frusto-conical member which is adapted to frictionally engage the outer wall of said second tube, discharge means comprising a third tube means extending laterally into and fluidly communicating with said first tube for the passage of fluid therefrom, said discharge means being positioned substantially at the top of said second tube, said discharge means terminating in a downwardly turned segment for directing liquid bath products in a substantially downward direction, said third tube laterally extending through opening means in said annular skirt depending from said frusto-conical member, coil spring resilient means positioned inside of said first tube and under said second tube for resiliently spacing said first intake and said second intake.

2. The apparatus of claim 1 where said securing means comprises outwardly facing adhesive surface means secured to said horizontal member means.

3. The apparatus of claim 1 where said metering and dispensing apparatus comprise four metering and dispensing means.

* * * * *